US009576531B2

(12) United States Patent
Park et al.

(10) Patent No.: US 9,576,531 B2
(45) Date of Patent: Feb. 21, 2017

(54) DISPLAY DEVICE AND DRIVING METHOD THEREOF

(71) Applicant: Samsung Display Co., Ltd., Yongin (KR)

(72) Inventors: Jong-Woong Park, Yongin (KR); Dong-Wook Yang, Yongin (KR); Won-Woo Jang, Yongin (KR); Byung-Ki Chun, Yongin (KR); Yong-Seok Choi, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 83 days.

(21) Appl. No.: 14/568,407

(22) Filed: Dec. 12, 2014

(65) Prior Publication Data

US 2015/0228224 A1 Aug. 13, 2015

(30) Foreign Application Priority Data

Feb. 13, 2014 (KR) ..... 10-2014-0016683

(51) Int. Cl.
*G09G 3/32* (2016.01)

(52) U.S. Cl.
CPC .... *G09G 3/3233* (2013.01); *G09G 2320/0673* (2013.01); *G09G 2360/16* (2013.01)

(58) Field of Classification Search
CPC ..... G09G 3/3233; G09G 3/32; G09G 3/3266; G09G 3/3275; G09G 2320/0271; G09G 2360/16; G09G 2320/0626; G09G 2310/08; G09G 2320/0233; G09G 2320/0673
See application file for complete search history.

(56) References Cited

U.S. PATENT DOCUMENTS

2004/0091169 A1* 5/2004 Park ..... G06T 5/40 382/274
2005/0104837 A1* 5/2005 Baik ..... G09G 3/342 345/99
2006/0119739 A1 6/2006 Chang et al.
2008/0001889 A1* 1/2008 Chun ..... G09G 3/2011 345/96

(Continued)

FOREIGN PATENT DOCUMENTS

KR 1020040038240 5/2004
KR 1020040049727 6/2004

(Continued)

*Primary Examiner* — Md Saiful A Siddiqui
(74) *Attorney, Agent, or Firm* — Cantor Colburn LLP

(57) ABSTRACT

A display device includes a pixel unit including scan lines, data lines crossing the scan lines, and pixels connected to the scan lines and the data lines; a timing control unit configured to receive first data from an outside; a conversion unit configured to receive the first data from the timing control unit, to extract luminance components of the first data corresponding to the pixels to determine luminance distribution of the first data, to divide the luminance distribution into a plurality of luminance distribution ranges, and to convert the first data into second data by regulating an input gray level of the first data based on a conversion equation corresponding to a variation between data of the luminance distribution ranges; and a data drive unit configured to receive the second data from the conversion unit and to provide the second data to the data lines.

18 Claims, 8 Drawing Sheets

(56) References Cited

U.S. PATENT DOCUMENTS

| | | | | |
|---|---|---|---|---|
| 2008/0111775 | A1* | 5/2008 | Han | G06T 5/009 345/77 |
| 2010/0265263 | A1* | 10/2010 | Hsu | G09G 3/3406 345/589 |
| 2012/0032998 | A1* | 2/2012 | An | G09G 3/3696 345/690 |
| 2013/0033517 | A1* | 2/2013 | Choi | H04N 1/60 345/593 |

FOREIGN PATENT DOCUMENTS

| | | |
|---|---|---|
| KR | 1020060062335 | 6/2006 |
| KR | 1020130015179 A | 2/2013 |

* cited by examiner

DISPLAY DEVICE AND DRIVING METHOD THEREOF

This application claims priority to Korean Patent Application No. 10-2014-0016683, filed on Feb. 13, 2014, and all the benefits accruing therefrom under 35 U.S.C. §119, the content of which in its entirety is herein incorporated by reference.

BACKGROUND

1. Field

Exemplary embodiments of the invention relate to a display device with improved visibility and a method of driving the display device.

2. Description of the Related Art

In recent years, there have been developed various types of flat-panel display devices having light weight and thin thickness without using a cathode ray tube, e.g., a liquid crystal display ("LCD") device, a plasma display panel ("PDP"), an organic light emitting display ("OLED") device, etc.

The flat-panel display device is typically applied to a display of a television and a personal portable terminal such as a smartphone, a laptop computer or a digital camera. When such a display device is used in the personal portable terminal having limited battery capacity, power consumption of the personal portable terminal depends on power consumption of the display device.

For example, among the flat-panel display devices, the OLED device emits light depending on a change in current amount, and current consumption is high at the time of emitting bright light.

SUMMARY

A driving method for reducing power consumption may be used in a display device, e.g., an organic light emitting display ("OLED") device. Recently, automatic current limit, which controls a current amount consumed in a display panel depending on an input image to reduce the power consumption, has been researched.

Exemplary embodiments of the invention provide a display device with improved visibility of an image and a method of driving the display device to improve the visibility, by extracting a luminance component from input image data, determining luminance distribution of the image data through a histogram analysis thereon, dividing the determined luminance distribution into a plurality of luminance distribution ranges, and converting the image data using a corresponding conversion equation determined based on a variation between the data of the respective luminance distribution ranges.

An exemplary embodiment of the invention provides a display device including a pixel unit configured to include a plurality of scan lines, a plurality of data lines crossing the scan lines, and a plurality of pixels connected to the scan lines and the data lines; a timing control unit configured to receive first data from an outside; a conversion unit configured to receive the first data from the timing control unit, to extract luminance components of the first data corresponding to the pixels to determine luminance distribution of the first data, to divide the luminance distribution into a plurality of luminance distribution ranges, and to convert the first data into second data by regulating an input gray level of the first data based on a conversion equation corresponding to a variation between data of the luminance distribution ranges;

and a data drive unit configured to receive the second data from the conversion unit and to provide the second data to the data lines.

In an exemplary embodiment, the conversion unit may include a first data converter configured to extract the luminance components of the first data corresponding to the pixels; a histogram analyzer configured to perform a histogram analysis on the extracted luminance components of the first data to determine the luminance distribution of the first data by analyzing histogram information about the extracted luminance components, and calculating the number of respective pixels corresponding to the extracted luminance components; a conversion curve generator configured to divide the luminance distribution into the plurality of luminance distribution ranges based on the luminance distribution of the first data, and to regulate the input gray level of the first data using the conversion equation corresponding to the variation between the data of the luminance distribution ranges; and a second data converter configured to convert the first data into the second data using the regulated gray level.

In an exemplary embodiment, the plurality of luminance distribution ranges may include a first luminance distribution range which is a low luminance range, a second luminance distribution range which is a medium luminance range, and a third luminance distribution range which is a high luminance range.

In an exemplary embodiment, a gradient of the conversion equation for regulating the input gray level may be continuously changed depending on the input gray level of the first data In an exemplary embodiment, when the data of the first and second luminance distribution ranges among the plurality of luminance distribution ranges is increased from the first luminance distribution range to the second luminance distribution range, the gradient of the conversion equation may increase as the input gray level of the first data increases in the first luminance distribution range and the second luminance distribution range, and when the data of the first and second luminance distribution ranges decreases from the first luminance distribution range to the second luminance distribution range, the gradient of the conversion equation may decrease as the input gray level of the first data increases in the first luminance distribution range and the second luminance distribution range.

In an exemplary embodiment, the conversion equation may be one of a first conversion equation for regulating the gray level of the first data less than a preset reference gray-level value (ref) and a second conversion equation for regulating the gray level of the first data greater than the reference gray-level value (ref).

In an exemplary embodiment, the first conversion equation may satisfy the following equation: regulation gray level (y)=first gradient (a1)×input gray level (x), the first gradient (a1) may satisfy the following equation: a1=((1−first gradient reference value (as1))/reference gray-level value (ref))×input gray level (x)+first gradient reference value (as1), the second conversion equation may satisfy the following equation: regulation gray level (y)=second gradient (a2)×(input gray level (x)−reference gray-level value (ref))+reference gray-level value (ref), the second gradient (a2) may satisfy the following equation: a2=((1−second gradient reference value (as2))/(maximum gray level−reference gray-level value (ref))×(input gray level (x)−maximum gray level)+1, where the first gradient reference value (as1) and the second gradient reference value (as2) may be preset constants corresponding to the variation between the data of the luminance distribution ranges.

In an exemplary embodiment, when the data of the first luminance distribution range and the second luminance distribution range decreases from the first luminance distribution range to the second luminance distribution range and the data of the second luminance distribution range and the third luminance distribution range increases from the second luminance distribution range to the third luminance distribution range, the reference gray-level value (ref) may be set to be a gray-level value within the second luminance distribution range.

In an exemplary embodiment, the reference gray-level value may be set to be a gray level of 150, the first gradient reference value (as1) may be set to be 2, and the second gradient reference value (as2) may be set to be 0.25, and the gradient (a1) of the first conversion equation may be set to be 1 or greater, and the gradient (a2) of the second conversion equation may be set to be 1 or less.

In an exemplary embodiment, when the data of the first luminance distribution range and the second luminance distribution range increases from the first luminance distribution range to the second luminance distribution range and the data of the second luminance distribution range and the third luminance distribution range decreases from the second luminance distribution range to the third luminance distribution range, the reference gray-level value (ref) may be set to be a gray-level value within the second luminance distribution range.

In an exemplary embodiment, the reference gray-level value may be set to be a gray level of 125, the first gradient reference value (as1) may be set to be 0.25, and the second gradient reference value (as2) may be set to be 2, and the gradient (a1) of the first conversion equation may be set to be 1 or less, and the gradient (a2) of the second conversion equation may be set to be 1 or greater.

In an exemplary embodiment, when the data of the first luminance distribution range and the second luminance distribution range decreases from the first luminance distribution range to the second luminance distribution range and the data of the second luminance distribution range and the third luminance distribution range decreases from the second luminance distribution range to the third luminance distribution range, the reference gray-level value (ref) may be set to be a maximum gray level.

In an exemplary embodiment, when the reference gray-level value is set to be the maximum gray level, the input gray level may be converted using only the first conversion equation, the first gradient reference value (as1) may be set to be 1.80, and the gradient (a1) of the first conversion equation may be set to be 1 or greater.

In an exemplary embodiment, when the data of the first luminance distribution range and the second luminance distribution range increases from the first luminance distribution range to the second luminance distribution range and the data of the second luminance distribution range and the third luminance distribution range increases from the second luminance distribution range to the third luminance distribution range, the reference gray-level value (ref) may be set to be a minimum gray level.

In an exemplary embodiment, when the reference gray-level value is set to be the minimum gray level, the input gray level may be converted using only the second conversion equation, the second gradient reference value (as2) may be set to be 0.50, and the gradient (a2) of the second conversion equation may be set to be 1 or less.

Another exemplary embodiment of the invention provides a method of driving the display device including: extracting luminance components of first data provided from an outside, where a plurality of pixels of the display device display an image corresponding to the first data; calculating the number of respective corresponding to the extracted luminance components by analyzing histogram information about the extracted luminance components; dividing the luminance distribution into first to third luminance distribution ranges using information about luminance distribution of the first data determined based on the analyzed histogram information, and regulating an input gray level of the first data using a conversion equation corresponding to a variation between data of the luminance distribution ranges; and converting the first data into second data using the regulated gray level.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
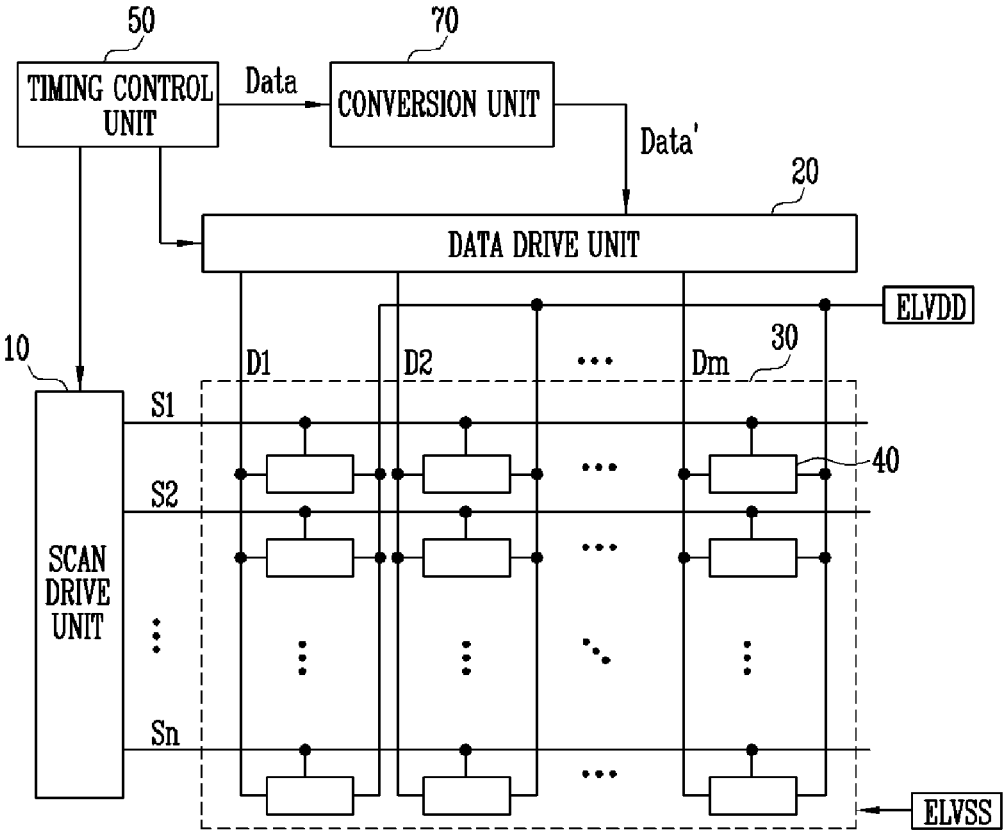
FIG. 1 is a block diagram showing an exemplary embodiment of a display device according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

Hereinafter, exemplary embodiments of the invention will be described in detail with reference to the accompanying drawings.

Figure 2:
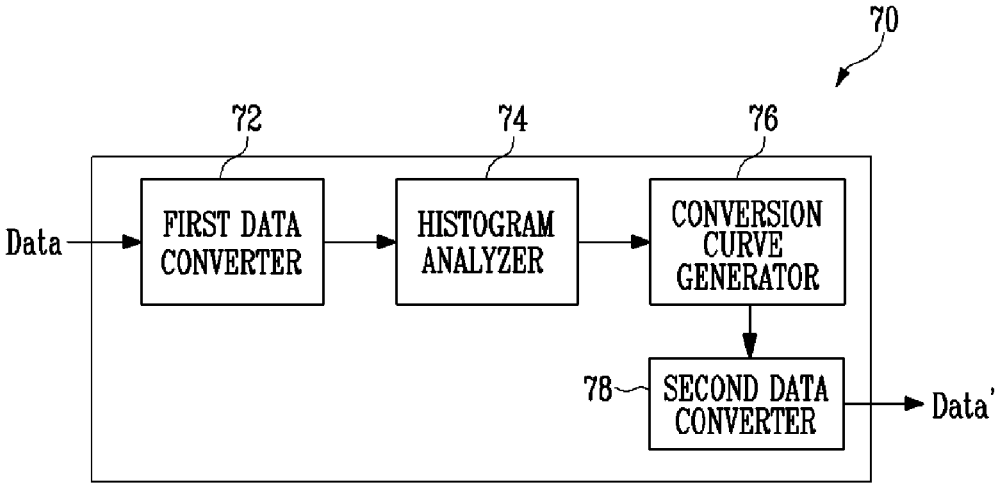
FIG. 2 is a block diagram showing an exemplary embodiment of a conversion unit in FIG. 1.

FIG. 1 is a block diagram showing an exemplary embodiment of a display device according to the invention, and FIG. 2 is a block diagram showing an exemplary embodiment of a conversion unit in FIG. 1.

In an exemplary embodiment, as shown in FIG. 1, the display device may be an organic light emitting display ("OLED") device. However, in exemplary embodiments of the invention, the display device is not limited to the OLED device.

Referring to FIG. 1, an exemplary embodiment of the display device according to the invention includes a pixel unit 30 configured to include a plurality of pixels 40 connected to scan lines S1 to Sn and data lines D1 to Dm, a scan drive unit 10 configured to drive the scan lines S1 to Sn, a data drive unit 20 configured to drive the data lines D1 to Dm, a timing control unit 50 configured to control the scan drive unit 10 and the data drive unit 20, and a conversion unit 70 configured to receive first data Data from the timing control unit 50, to convert the first data into second data Data', and then to transmit the converted data Data' to the data drive unit 20.

The timing control unit 50 generates a data drive control signal and a scan drive control signal in response to synchronizing signals supplied from an outside. The data drive control signal generated in the timing control unit 50 is supplied to the data drive unit 20, and the scan drive control signal generated in the timing control unit 50 is supplied to the scan drive unit 10. In such an embodiment, the timing control unit 50 is configured to supply the first data Data from the outside to the conversion unit 70.

The scan drive unit 10 receives the scan drive control signal from the timing control unit 50. The scan drive unit 10 is configured to receive the scan drive control signal, to generate a scan signal, and to sequentially transmit the generated scan signal to the scan lines S1 to Sn.

The data drive unit 20 is configured to receive the data drive control signal from the timing control unit 50, to receive the second data Data' from the conversion unit 70, and to thereby transmit the second data Data' to the data line D1 to Dm in synchronization with the scan signal.

The pixel unit 30 is configured to receive first power ELVDD and second power ELVSS from the outside and then supply the power to the respective pixels 40. The respective pixels 40 receive the first power ELVDD and the second power ELVSS, and thereby generate light that corresponds to a data signal by controlling current that flows from the first power ELVDD through a luminous element to the second power ELVSS in response to the data signal. In such an embodiment, the respective pixels 40 generate light of a predetermined luminance based on the data signal.

The conversion unit 70, which implements a visible shape of an image, is configured to extract an external data signal supplied from the timing control unit 50, that is, luminance components Y of the first data Data, determine luminance distribution of the first data Data (distribution of the luminance components Y of the first data) through a histogram analysis, divide the luminance distribution into a plurality of luminance distribution ranges, and convert the first data Data into the second data Data' using a conversion equation corresponding to a variation between the data of the respective luminance distribution ranges.

In an exemplary embodiment, referring to FIG. 2, the conversion unit 70 may be configured to include a first data converter 72, a histogram analyzer 74, a conversion curve generator 76, and a second data converter 78.

The first data converter 72 extracts the Y value that is the luminance components of the external data signal supplied from the timing control unit 50, e.g., the first data Data.

In one exemplary embodiment, for example, the first data converter 72 may convert RGB data that is input as the first data Data into a color space data including a luminance value and a chrominance value, e.g., YCbCr data. In such an embodiment, one first data may be converted into one luminance value Y and two chrominance values, and the chrominance values may include a blue chrominance value Cb and a red chrominance value Cr. Various methods may be used to convert the RGB data into the YCbCr data, which are well known to those skilled in art, and any detailed description thereof will be omitted herein.

In an exemplary embodiment, the YCbCr data (e.g., the Y value of the YCbCr data) output from the first data converter 72 is input into the histogram analyzer 74. The histogram analyzer 74 analyzes histogram information about Y values that are the luminance component of the extracted first data, and calculates the number of respective pixels corresponding to the extracted luminances.

Data applied to the pixels contains information about the luminance of each corresponding pixel, and the luminance may correspond to a grayscale level among a predetermined number of grayscale levels, for example, 1024 ($=2^{10}$), 256 ($=2^{8}$) or 64 ($=2^{6}$) grayscale levels. Herein, a gray level means a grayscale level.

In such an embodiment, the luminance and the gray level of the data has a positive (+) correlation, such that a high luminance value corresponds to high gray-level data and a low luminance value corresponds to low gray-level data.

Hereinafter, an exemplary embodiment in which the total number of the gray levels is 256 will be described for convenience of description.

In such an embodiment, the conversion curve generator 76 divides the luminance distribution into the plurality of luminance distribution ranges using information about the luminance distribution of the first data determined through the histogram analysis, and changes, e.g., regulates, the gray level (input gray level) of the first data Data to improve visibility using a conversion equation corresponding to the variation between the data of the respective luminance distribution ranges.

The conversion equation that regulates the input gray level based on the analysis of the histogram information and the variation between the data of the respective luminance distribution ranges in the histogram information will be described later in detail with reference to exemplary embodiments shown in FIGS. 4 to 15.

In an exemplary embodiment of the conversion unit 70, the second data converter 78 converts the first data Data into the second data Data' using the regulated gray level and then outputs the converted data, e.g., the second data Data' to the data drive unit 20. In such an embodiment, the second data Data' is RGB data. In an exemplary embodiment, where the RGB data has been converted into the YCbCr data in the first data converter 72, the YCbCr data is converted back into the RGB data through the second data converter 78.

Figure 3:
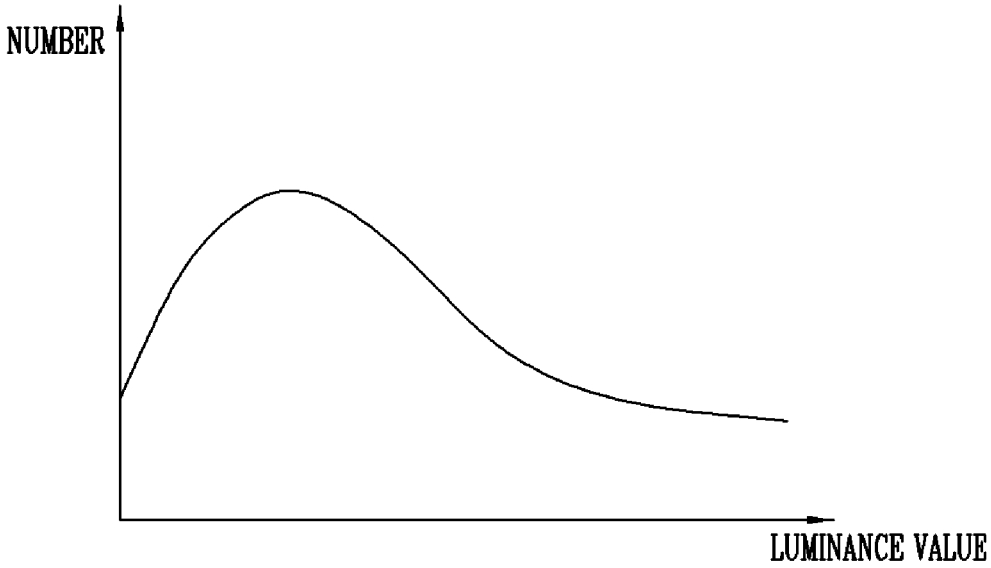
FIG. 3 is a graph showing a relation between histogram-analyzed luminance values and the number of pixels according to the luminance.

FIG. 3 is a graph showing a relation between histogram-analyzed luminance values and the number of pixels according to the luminance.

Assuming that the YCbCr data output from the first data converter 72 is obtained by converting the RGB data of one frame image, the number of the YCbCr data input into the histogram analyzer 74 is calculated according to the luminance, that is, the number of pixels determined to emit light corresponding to the respective luminance based on the RGB data. The number of the data according to the luminance may be calculated by the number of the pixels (number of data) having the same Y value among associated YCbCr data, and may correspond to each luminance value as shown in FIG. 3.

In an exemplary embodiment, the number of the pixels may be counted as a natural number and may be discrete. In such an embodiment, if the luminance values are based on digital input values, the luminance values may be discrete. In such an embodiment, if the number is assigned to correspond to the luminance value, the relation may be illustrated in a discontinuous graph. The graph shown in FIG. 3 has a continuous curve for convenience of illustration and to make it easy to understand the schematic relation, it will be understood that a real graph may be the discontinuous graph. The same applies to the graphs in other figures.

Hereinafter, exemplary embodiments will be described in detail with reference to FIGS. 4 to 15, in which the histogram-analyzed luminance values are divided into the plurality of luminance distribution ranges, which are divided into a plurality of groups, and the input gray level of the first data is regulated and converted based on the variation between the data of the respective luminance distribution ranges.

Hereinafter, exemplary embodiments where the histogram-analyzed luminance values are divided into three luminance distribution ranges will be described, but the invention is not limited thereto.

In an exemplary embodiment, the luminance distribution ranges may include a first luminance distribution range having low luminance, a second luminance distribution range having medium luminance, and a third luminance distribution range having high luminance. Each luminance distribution range may include at least one luminance value, or two or more continuous or neighboring luminance values.

In an exemplary embodiment, a minimum luminance value of the second luminance distribution range may be greater than a maximum luminance value of the first luminance distribution range, and a minimum luminance value of the third luminance distribution range may be greater than a maximum luminance value of the second luminance distribution range.

In such an embodiment, when a section between minimum and maximum values of whole luminance values is a whole luminance-value section, the minimum value of the whole luminance values may be a minimum luminance value of the first luminance distribution range, and the maximum value of the whole luminance values may be a maximum luminance value of the third luminance distribution range.

In such an embodiment, boundaries between the respective luminance distribution ranges may be points of internal division, which substantially divide the whole luminance-value section into 1:1:1. However, the division of the respective luminance distribution ranges is not limited thereto.

When the number of the luminance values in each luminance distribution range is 2 or greater, each luminance distribution range corresponds to a total number of the pixels emitting light with the associated luminance values.

Figure 4:
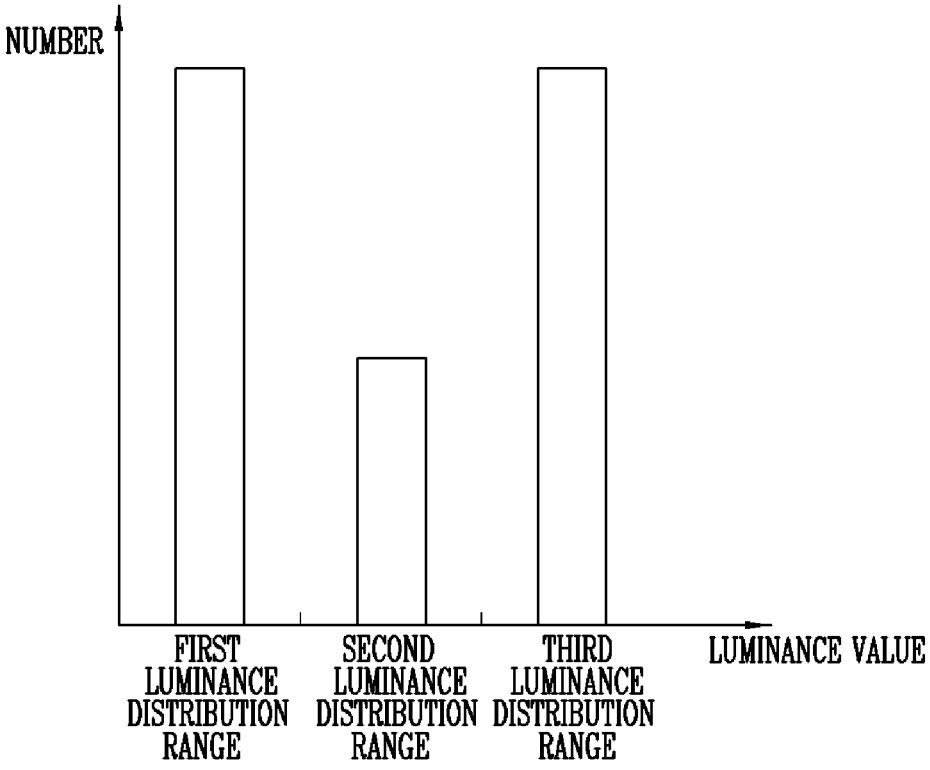
FIG. 4 is a graph showing a relation between luminance distribution ranges and the number of pixels in an exemplary embodiment of a display device according to the invention.
Figure 5:
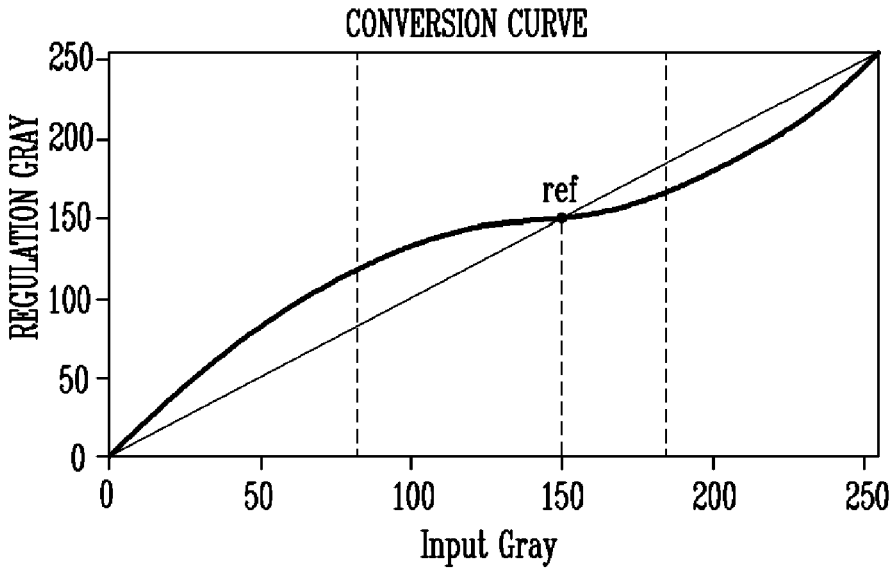
FIG. 5 is a graph showing a relation between an input gray level of first data shown in FIG. 4 and a regulation gray level that is to be converted as a function of the input gray level.
Figure 6:
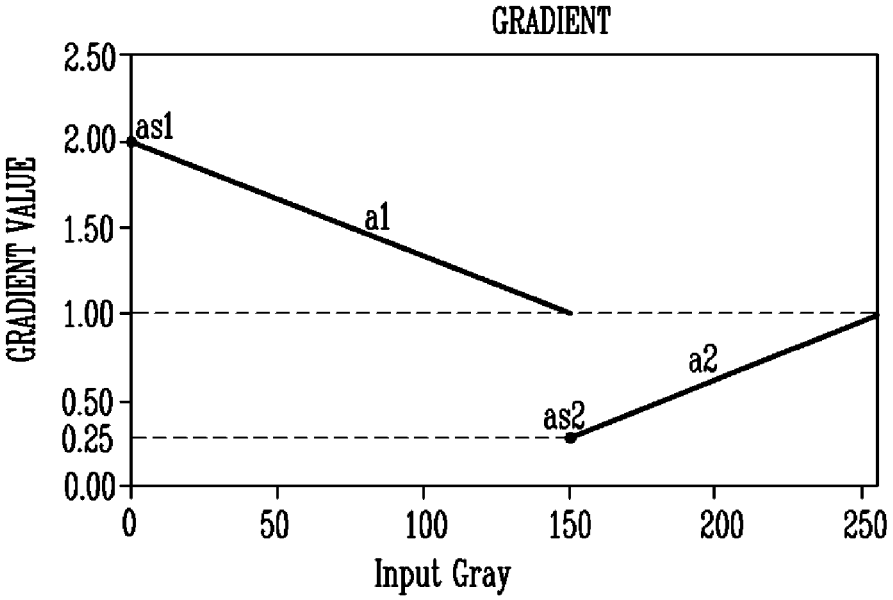
FIG. 6 is a graph showing a gradient applied to a conversion equation corresponding to the graph of FIG. 5.

FIG. 4 is a graph showing a relation between luminance distribution ranges and the number of pixels in an exemplary embodiment of the display device according to the invention, FIG. 5 is a graph showing a relation between an input gray level of first data corresponding to the exemplary embodiment of FIG. 4 and a regulation gray level that is to be converted as a function of the input gray level, and FIG. 6 is a graph showing a gradient applied to a conversion equation corresponding to the exemplary embodiment of FIG. 5.

FIG. 4 shows information that may be output by the histogram analyzer 74. That is, FIG. 4 is a graph that is obtained by dividing luminance values, which are luminance components of the extracted first data, into first to third luminance distribution ranges based on the luminance values, and then pairing the luminance distribution ranges with the number of pixels that emit light with the luminance value associated with each luminance distribution range.

In such an embodiment, the first luminance distribution range is a low luminance range, the second luminance distribution range is a medium luminance range, and the third luminance distribution range is a high luminance range.

Thus, data corresponding to the first luminance distribution range is data of a low gray level, data corresponding to the second luminance distribution range is data of a medium gray level, and data corresponding to the third luminance distribution range is data of a high gray level.

In an exemplary embodiment of the invention, the total number of the gray levels may be 256, that is, the gray level may have a value in a range from zero (0) to 255. In one exemplary embodiment, for example, the data corresponding to the first luminance distribution range may have the gray level having a value from 0 to 85, the data corresponding to the second luminance distribution range may have the gray level having a value from 86 to 170, and the data corresponding to the third luminance distribution range may have the gray level having a value from 171 to 255.

FIG. 4 shows an exemplary embodiment of the histogram information where data, e.g., the number of the pixels, corresponding to the second luminance distribution range is the smallest. Variation in gray level distribution of the data is as follows: the gray level distribution of the data decreases from the low luminance range (first luminance distribution range) to the medium luminance range (second luminance distribution range), and the gray level distribution of the data decreases from the medium luminance range (second luminance distribution range) to the high luminance range (third luminance distribution range).

In an exemplary embodiment, as shown in FIG. 4, the data of the low gray level and the data of the high gray level may be relatively greater than the data of the medium gray level, that is, the number of the pixels emitting light with the medium luminance may be less than the number of the pixels emitting light with the low luminance and the high luminance.

According to an exemplary embodiment of the invention, the input data, e.g., the gray level (input gray level) of the first data, is converted base on the variation between the data of the respective luminance distribution ranges, e.g., based on the difference in the number of the pixels in the respective luminance distribution ranges, and the gradient of the conversion equation for converting the gray level is continuously changed depending on the input gray level.

FIG. 5 illustrates an operation of converting the gray level of the data shown in FIG. 4 by the conversion curve generator 76.

In an exemplary embodiment, FIG. 5 is a graph showing a relation between the input gray level of the first data shown in FIG. 4 and the regulation gray level that is to be converted as a function of the input gray level, in which an X axis designates the input gray level and a Y axis designates the regulation gray level (converted gray level) corresponding to the input gray level.

Referring to FIG. 5, a conversion equation (first conversion equation) for data having a gray level less than a reference gray-level value (ref) is different from a conversion equation (second conversion equation) for data having a gray level greater than the reference gray-level value (ref). The first and second conversion equations are as follows.

$$y=a1x; \text{ and}$$

$$a1=((1-as1)/\text{ref})\times x+as1. \qquad \text{First Conversion Equation:}$$

In the first conversion equation, as1 and ref are preset constants, as1 denotes a first gradient reference value, and ref denotes a reference gray-level value.

$$y=a2(x-\text{ref})+\text{ref}; \text{ and}$$

$$a2=((1-as2)/(255-\text{ref}))\times(x-255)+1. \qquad \text{Second Conversion Equation:}$$

In the second conversion equation, as2 is a preset constant and denotes a second gradient reference value.

In the first and second conversion equations, y denotes the regulation gray level, and x denotes the input gray level.

According to an exemplary embodiment, the reference gray-level value (ref) may be set to a gray-level value within the second luminance distribution range. In such an embodiment, as shown in FIG. 5, the gray level of 150 may be set as the reference gray-level value.

In such an embodiment, as1 and as2 are reference values of the first gradient a1 and the second gradient a2, respectively, and mean gradient starting points in the respective conversion equations. In an exemplary embodiment, as1 and as2 may be determined based on the variation between the data of the respective luminance distribution ranges.

FIG. 6 is a graph showing gradients a1 and a2 applied to the first and second conversion equations. Referring to FIG. 6, in such an embodiment, when the relation between the luminance distribution ranges are as in FIG. 5, the first gradient reference value as1 as the starting point of the gradient a1 of the first conversion equation is set to be 2, and the second gradient reference value as2 as the starting point of the gradient a2 of the second conversion equation is set to be 0.25.

In such an embodiment, as shown in FIG. 6, the gradient a1 of the first conversion equation may be set to 1 or greater, and the gradient a2 of the second conversion equation may be set to 1 or less.

Referring back to FIG. 5, in the section where the first conversion equation is applied, a rate of change of the regulation gray level with respect to the input gray level may be adjusted to be greater than 1. In the section where the second conversion equation is applied, a rate of change of the regulation gray level with respect to the input gray level may be adjusted to be less than 1.

In such an embodiment, when the input gray level is the reference gray-level value (ref) that is the boundary between the first and second conversion equations, the gray level regulated by the first conversion equation may be equal to the gray level regulated by the second conversion equation.

Referring to FIG. 6, according to an exemplary embodiment of the invention, a change in gradient may be detected by analyzing a variation in the gray level distribution of the data, that is, variation between the data of the respective luminance distribution ranges through the histogram analysis, and then using the variation between the data of the respective luminance distribution ranges.

In such an embodiment, when the of data of the gray level distribution ranges decreases from the low luminance range (first luminance distribution range) to the medium luminance range (second luminance distribution range), the gradient a1 of the first conversion equation also decreases in proportion to the decrease in gray level distribution. If the data of the gray level distribution ranges is increased from the medium luminance range (second luminance distribution range) to the high luminance range (third luminance distribution range), the gradient a2 of the second conversion equation increases in proportion to the increase in gray level distribution.

Accordingly, in such an embodiment, the gradients a1 and a2 applied to the first and second conversion equations, respectively, and implemented in a linear equation are continuously changed based on the input gray level x, thus removing kink points that may occur in gamma correction and thereby improving the visibility of the image.

Referring to the graph of FIG. 5, in an exemplary embodiment, changes of the gradients in the first and third luminance distribution ranges are greater than a change of the gradient in the second luminance distribution range.

In such an embodiment, a difference between the input and regulation gray levels is relatively great in the first and third luminance distribution ranges in which a greater number of pixels are present, and a difference between the input and regulation gray levels is relatively less in the second luminance distribution range in which a smaller number of pixels are present.

Therefore, in such an embodiment, pieces of data belonging to the first and third luminance distribution ranges having the relatively greater number of pixels are effectively distinguished from each other when displayed as an image.

In such an embodiment, an automatic-current-limit driving method of controlling a current amount in the display panel to reduce power consumption may be applied, and the gray levels of the relatively greater number of pixels are effectively distinguished from each other even when the level of the luminance value of an image data to be displayed is reduced due to the automatic-current-limit driving method, thus improving the visibility. In such an embodiment, a method of selectively improving the visibility of an important display image is used, as the number of pixels belonging to each luminance distribution range is substantially proportional to the importance of an image that is to be displayed.

A change-rate for adjusting degree of the regulation gray level for the input gray level in each luminance distribution range may depend on or be determined based on a difference in the number of the associated pixels according to the luminance distribution range, an improved degree of the visibility, the presence of a subsequent luminance-value adjusting operation, a scale, etc.

Figure 7:
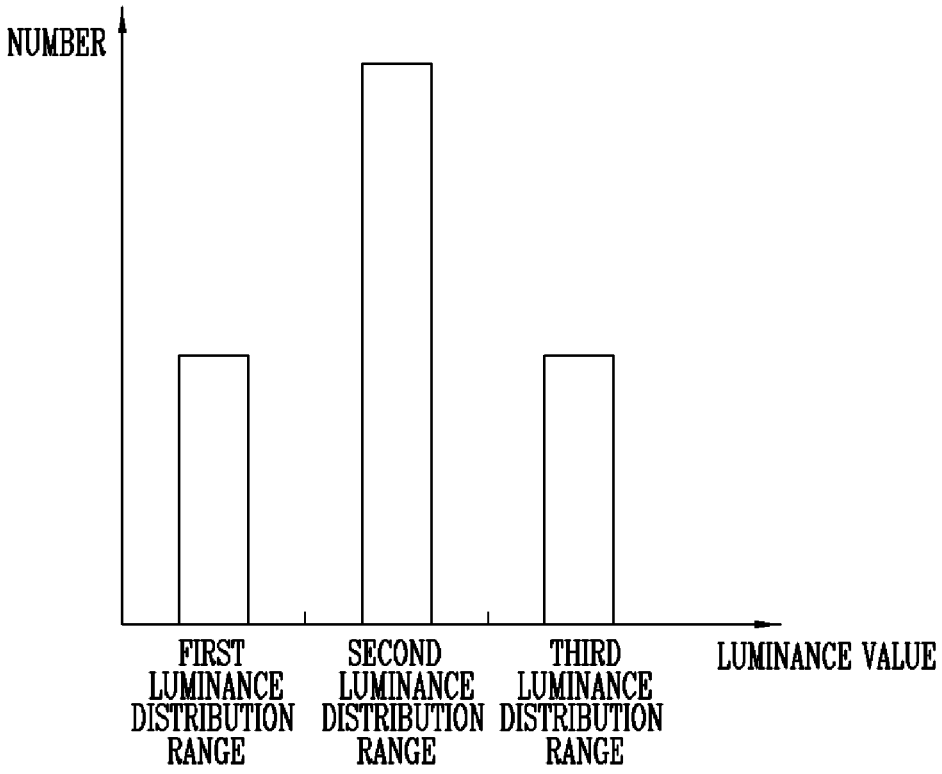
FIG. 7 is a graph showing another relation between luminance distribution ranges and the number of pixels in an exemplary embodiment of a display device according to the invention.
Figure 8:
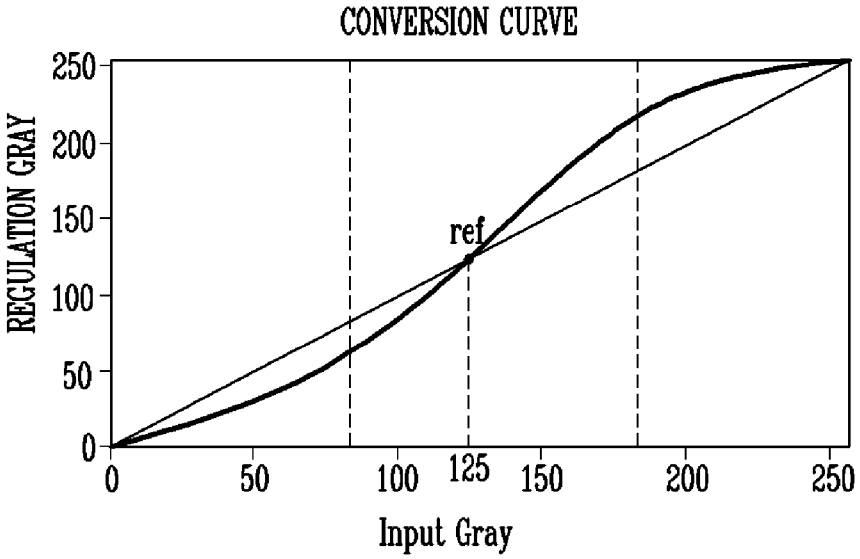
FIG. 8 is a graph showing a relation between an input gray level of first data shown in FIG. 7 and a regulation gray level that is to be converted as a function of the input gray level.
Figure 9:
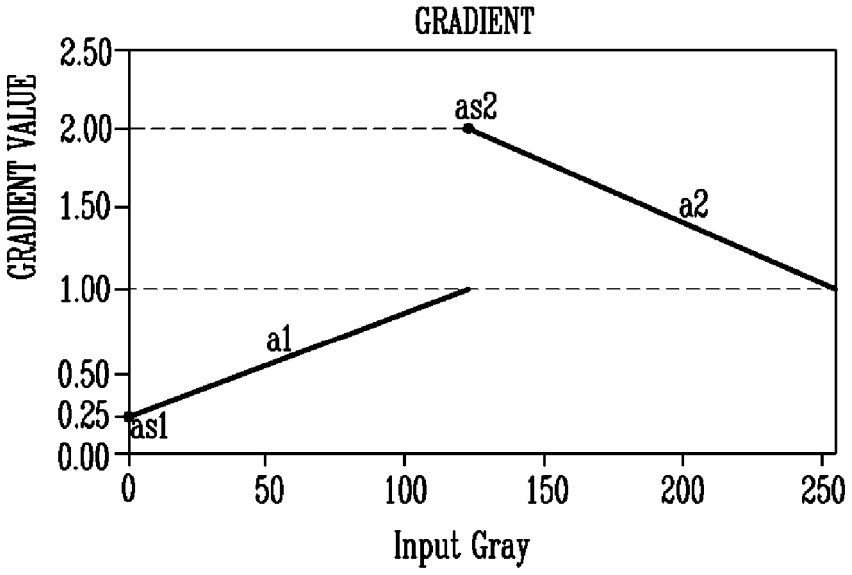
FIG. 9 is a graph showing a gradient applied to a conversion equation corresponding to the graph of FIG. 8.

FIG. 7 is a graph showing another relation between luminance distribution ranges and the number of pixels in an exemplary embodiment of the invention, FIG. 8 is a graph showing a relation between an input gray level of first data shown in FIG. 7 and a regulation gray level that is to be converted as a function of the input gray level, and FIG. 9 is a graph showing a gradient applied to a conversion equation corresponding to the graph shown in FIG. 8.

In the graphs of FIGS. 7 to 9, data corresponding to the second luminance distribution range is the greatest. In an exemplary embodiment, as described above, the input data, e.g., the gray level (input gray level) of the first data, is converted base on the variation between the data of the respective luminance distribution ranges, and the gradient of the conversion equation for converting the gray level is continuously changed depending on the input gray level.

FIG. 7 shows information that may be output by the histogram analyzer 74 based the first, and represents a variation where the data of the gray level distribution ranges is increased from the low luminance range (first luminance distribution range) to the medium luminance range (second luminance distribution range), and the data of the gray level distribution ranges decreases from the medium luminance range (second luminance distribution range) to the high luminance range (third luminance distribution range).

FIG. 7 shows an exemplary embodiment of the histogram information where the data of the low gray level and the data of the high gray level are relatively less than the data of the medium gray level, and means that the number of the pixels emitting light with the medium luminance is greater than the number of the pixels emitting light with the low luminance and the high luminance.

According to an exemplary embodiment of the invention, the gray level (input gray level) of the input data, e.g., the first data, is converted base on the variation between the data of the respective luminance distribution ranges. The gradient of the conversion equation for converting the gray level is continuously changed depending on the input gray level.

FIG. 8 illustrates an operation of converting the gray level of data shown in FIG. 7 by the conversion curve generator 76.

FIG. 8 is a graph representing the relation between the input gray level shown in FIG. 7 and the regulation gray level changed according to the input gray level, in which the X axis denotes the input gray level and the Y axis denotes the regulation gray level corresponding to the input gray level.

Referring to FIG. 8, the conversion equation (first conversion equation) for data having the gray level less than a reference gray-level value (ref) is different from the conversion equation (second conversion equation) for data having the gray level greater than the reference gray-level value (ref). The first and second conversion equations are as follows.

$y=a1x$; and $a1=((1-as1)/\text{ref})\times x+as1$. First Conversion Equation:

In the first conversion equation, as1 and ref are preset constants, as1 denotes a first gradient reference value and ref denotes a reference gray-level value.

$y=a2(x-\text{ref})+\text{ref}$; and $a2=((1-as2)/(255-\text{ref}))\times(x-255)+1$. Second Conversion Equation:

In the second conversion equation, as2 is a preset constant and denotes a second gradient reference value.

In the first and second conversion equations, y denotes a regulation gray level, and x denotes an input gray level.

According to an exemplary embodiment, the reference gray-level value (ref) may be set as a gray-level value within the second luminance distribution range. In one exemplary embodiment, for example, the gray level of 125 may be established as the reference gray-level value as shown in FIG. 8.

In such an embodiment, as1 and as2 are the reference values of the first and second gradients a1 and a2, respectively, which mean the gradient starting points in the respective conversion equations. In an exemplary embodiment, as1 and as2 may be determined based on the variation between the data of the respective luminance distribution ranges.

FIG. 9 is a graph showing the gradients a1 and a2 that are applied to the first and second conversion equations. Referring to FIG. 9, in an exemplary embodiment, when the relation between the luminance distribution ranges are as in FIG. 8, the first gradient reference value as1 as the starting point of the gradient a1 of the first conversion equation is set to be 0.25, while the second gradient reference value as2 as the starting point of the gradient a2 of the second conversion equation is set to be 2.

In such an embodiment, as shown in FIG. 9, the gradient a1 of the first conversion equation may be set to be 1 or less, and the gradient a2 of the second conversion equation may be set to be 1 or greater.

That is, referring to FIG. 9, in a section where the first conversion equation is applied, a rate of change in regulation gray level with respect to the input gray level, that is, a ratio of the regulation gray level with respect to the input gray level, may be adjusted to be less than 1. Further, in a section where the second conversion equation is applied, a rate of change in regulation gray level with respect to the input gray level may be adjusted to be greater than 1.

In an exemplary embodiment, when the input gray level is the reference gray-level value that is the boundary between the first and second conversion equations, the gray level regulated by the first conversion equation may be equal to the gray level regulated by the second conversion equation.

In such an embodiment, as shown in FIGS. 5, 6 8 and 9, when the variation in gray level distribution is different as shown in FIGS. 3 and 7, the first and second gradients a1 and a2 applied to the first and second conversion equations and the starting points as1 and as2 of the first and second gradients become different.

Referring to FIG. 9, according to an exemplary embodiment of the invention, a change in gradient is determined by analyzing variation in the gray level distribution of the data, namely, the variation between the data of the respective luminance distribution ranges through the histogram analysis, and then applying the variation between the data of the respective luminance distribution ranges.

In an exemplary embodiment, when the data of the gray level distribution ranges is increased from the low luminance range (first luminance distribution range) to the medium luminance range (second luminance distribution range), the gradient of the first conversion equation also increases in proportion to the increase in gray level distribution. In such an embodiment, when the data of the gray level distribution ranges decreases from the medium luminance range (second luminance distribution range) to the high luminance range (third luminance distribution range), the gradient of the second conversion equation decreases in proportion to the decrease in gray level distribution.

Accordingly, in such an embodiment, the gradients applied, respectively, to the first and second conversion equations implemented in a linear equation are continuously changed according to the input gray level x, thus removing kink points that may occur in gamma correction and thereby improving the visibility of an image.

Referring to the graph of FIG. 8, a change in gradient (that is, difference between the input gray level and the regulation gray level) in the second luminance distribution range is greater than changes in gradients in the first and third luminance distribution ranges.

This means that a difference between the input and regulation gray levels is relatively great in the second luminance distribution range in which a greater number of pixels are present, and a difference between the input and regulation gray levels is relatively less in the first and third luminance distribution ranges in which a smaller number of pixels are present.

Therefore, in such an embodiment, pieces of data belonging to the second luminance distribution range having the relatively greater number of pixels are effectively distinguished from each other when displayed as an image.

Figure 10:
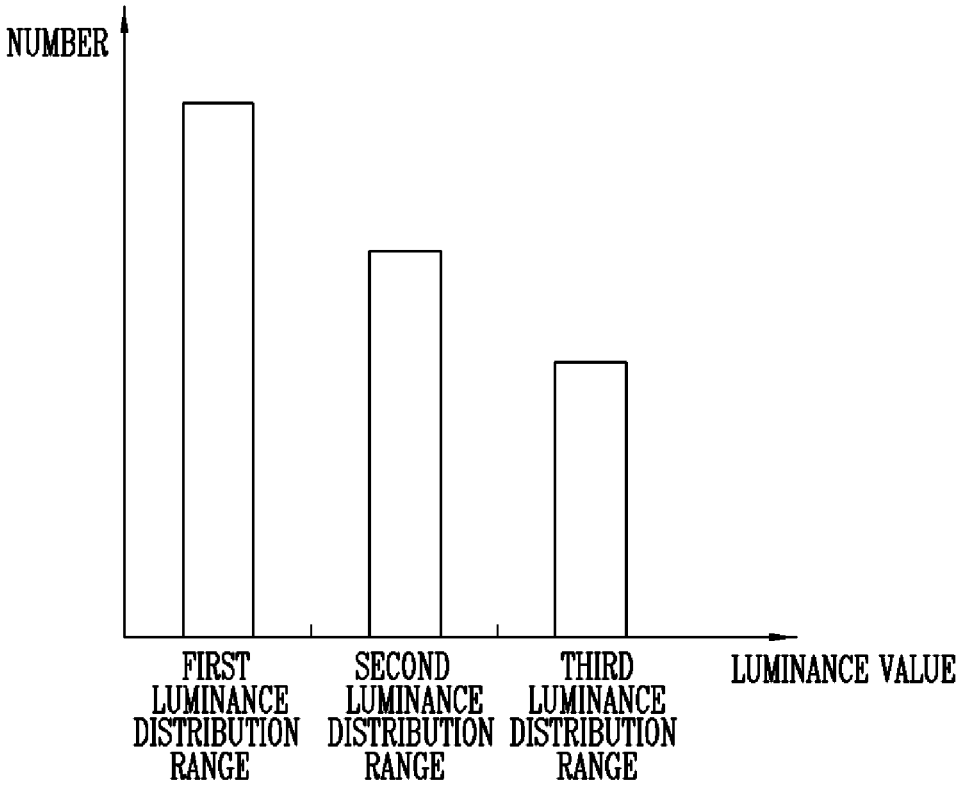
FIG. 10 is a graph showing another relation between luminance distribution ranges and the number of pixels in an exemplary embodiment of a display device according to the invention.
Figure 11:
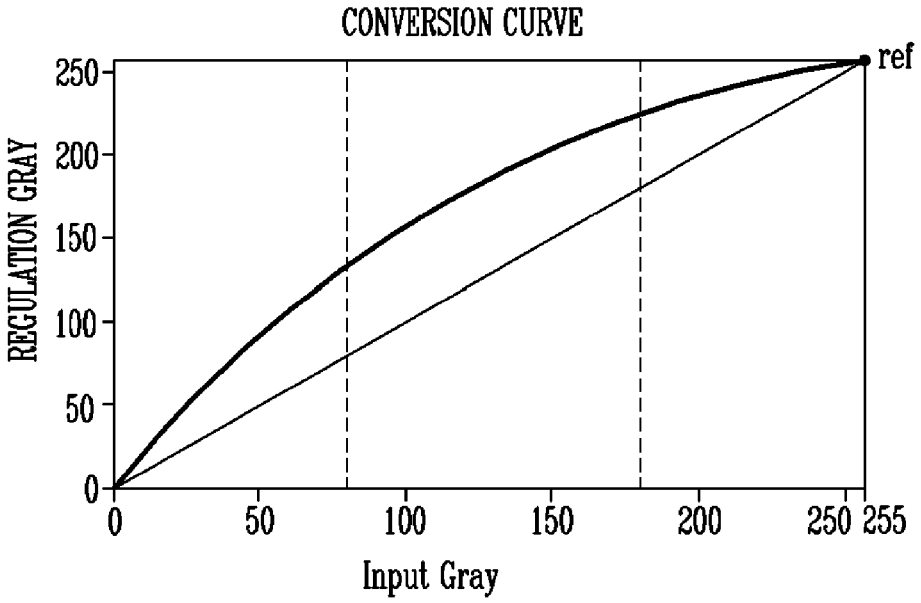
FIG. 11 is a graph showing a relation between an input gray level of first data shown in FIG. 10 and a regulation gray level that is to be converted as a function of the input gray level.
Figure 12:
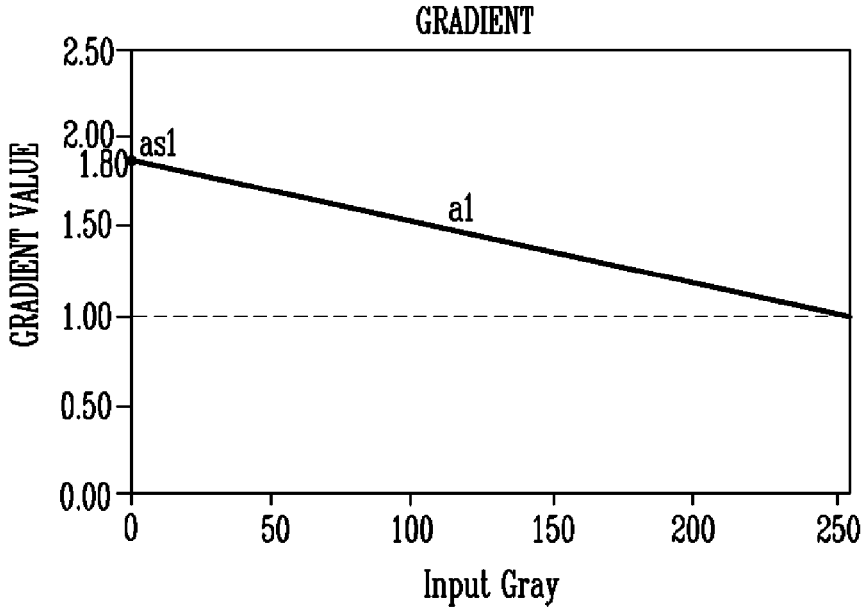
FIG. 12 is a graph showing a gradient applied to a conversion equation corresponding to the graph of FIG. 11.

FIG. 10 is a graph showing a relation between luminance distribution ranges and the number of pixels in an exemplary embodiment of the invention, FIG. 11 is a graph showing a relation between an input gray level of first data of FIG. 10 and a regulation gray level that is to be converted as a function of the input gray level, and FIG. 12 is a graph showing a gradient applied to a conversion equation corresponding to the graph of FIG. 11.

In an exemplary embodiment, as shown in FIG. 10, the number of pieces of associated data may gradually decrease from the first luminance distribution range to the third luminance distribution range.

FIG. 10 shows information that is output by the histogram analyzer 74, and represents a variation where the data of the gray level distribution ranges is decreases from the low luminance range (first luminance distribution range) to the high luminance range (third luminance distribution range).

In such an embodiment, the data of the gray level distribution ranges may decrease from the low luminance range (first luminance distribution range) to the medium luminance range (second luminance distribution range), and the data of the gray level distribution ranges decrease from the medium luminance range (second luminance distribution range) to the high luminance range (third luminance distribution range).

FIG. 10 shows an exemplary embodiment of the histogram information where the data (the number of the pixels) of the low gray level is greater than the data of the medium gray level, and the data of the medium gray level is greater than the data of the high gray level. In an exemplary embodiment, the number of the pixels emitting light with the low luminance may be greater than the number of the pixels emitting light with the medium luminance and the high luminance.

According to an exemplary embodiment of the invention, the gray level (input gray level) of the input data, e.g., the first data, is converted base on the variation between the data of the respective luminance distribution ranges. The gradient of the conversion equation for converting the gray level is continuously changed depending on the input gray level.

FIG. 11 illustrates an operation of converting the gray level of data shown in FIG. 10 by the conversion curve generator 76.

FIG. 11 is a graph representing a relation between the input gray level shown in FIG. 10 and the regulation gray level changed according to the input gray level, in which the X axis denotes the input gray level and the Y axis denotes the regulation gray level corresponding to the input gray level.

Referring to FIG. 11, the conversion equation (first conversion equation) for data having the gray level less than a reference gray-level value (ref) is different from the conversion equation (second conversion equation) for data having the gray level greater than the reference gray-level value (ref). The first and second conversion equations are as follows.

$$y=a1x; \text{ and}$$

$$a1=((1-as1)/\text{ref})\times x+as1. \qquad \text{First Conversion Equation:}$$

In the first conversion equation, as1 and ref are preset constants, as1 denotes a first gradient reference value, and ref denotes a reference gray-level value.

$$y=a2(x-\text{ref})+\text{ref}; \text{ and}$$

$$a2=((1-as2)/(255-\text{ref}))\times(x-255)+1. \qquad \text{Second Conversion Equation:}$$

In the second conversion equation, as2 is a preset constant and denotes a second gradient reference value.

In the first and second conversion equations, y denotes a regulation gray level, and x denotes an input gray level.

In an exemplary embodiment, the reference gray-level value (ref) may be set to be the gray level of 255 that is a maximum gray level, as shown in FIG. 11. In such an embodiment, since there is no data having a gray level greater than the reference gray level, the second conversion equation is not used.

In an exemplary embodiment, as1 and as2 may be determined based on the variation between the data of the respective luminance distribution ranges. In an exemplary embodiment, as shown in FIG. 10, when variation in data of the gray level distribution ranges may decrease from the low luminance range (first luminance distribution range) to the high luminance range (third luminance distribution range), the gray level of the data is converted only by the first conversion equation.

Thus, in FIG. 12, only the gradient a1 of the first conversion equation is shown.

FIG. 12 is a graph showing the gradient a1 that is applied to the first conversion equation. Referring to FIG. 11, in an exemplary embodiment, when the relation between the luminance distribution ranges are as in FIG. 11, the first gradient reference value as1 as the starting point of the gradient a1 of the first conversion equation may be set to be 1.80.

In such an embodiment, as shown in FIG. 12, the gradient a1 of the first conversion equation may be set to be 1 or greater.

Referring to FIG. 11, according to an exemplary embodiment of the invention, a change in gradient is determined by analyzing a variation in the gray level distribution of the data, namely, a variation between the data of the respective luminance distribution ranges through the histogram analysis, and then applying the variation between the data of the respective luminance distribution ranges.

In such an embodiment, when the data of the gray level distribution ranges gradually decreases from the low luminance range (first luminance distribution range) to the high luminance range (third luminance distribution range), the gradient of the first conversion equation also decreases in proportion to the decrease in gray level distribution.

In an exemplary embodiment of the invention, as described above, the gradient applied to the first conversion equation implemented in a linear equation is continuously changed according to the input gray level x, thus removing kink points that may occur in gamma correction and thereby improving the visibility of an image.

Referring to the graph of FIG. 12, a change in gradient in the first luminance distribution range may be greater than changes in gradients in the second and third luminance distribution ranges.

Accordingly, in an exemplary embodiment, a difference between the input and regulation gray levels is relatively great in the first luminance distribution range in which a greater number of pixels are present, and a difference between the input and regulation gray levels is relatively less in the second and third luminance distribution ranges in which a less number of pixels are present.

Therefore, in such an embodiment, pieces of data belonging to the first luminance distribution range having the relatively greater number of pixels are effectively distinguished from each other when displayed as an image.

Figure 13:
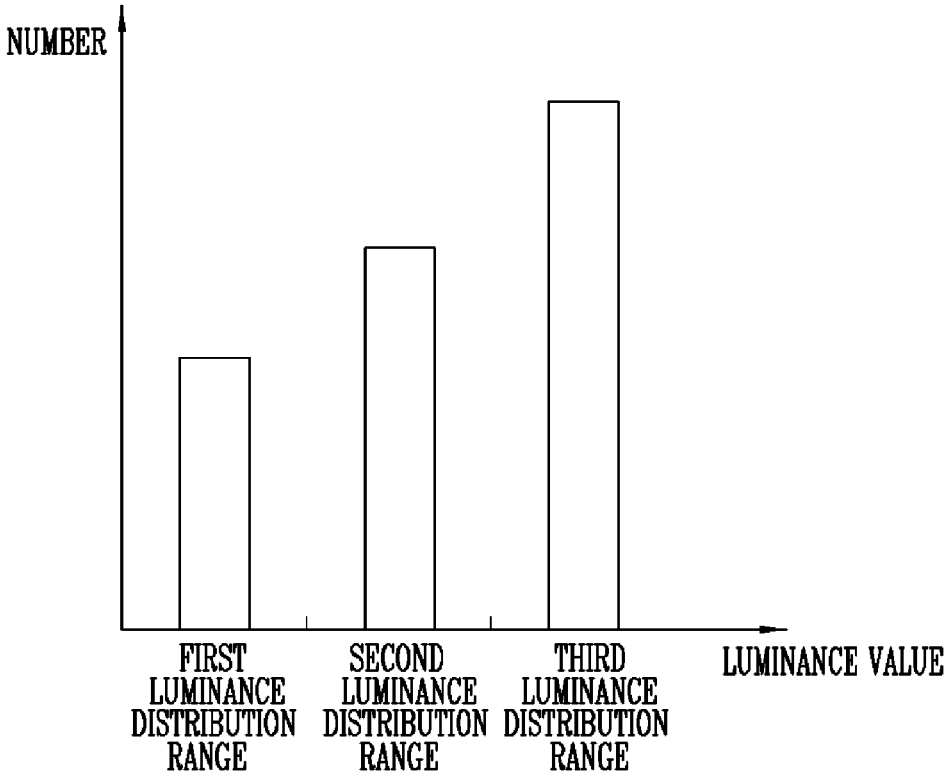
FIG. 13 is a graph showing another relation between luminance distribution ranges and the number of pixels in an exemplary embodiment of a display device according to the invention.
Figure 14:
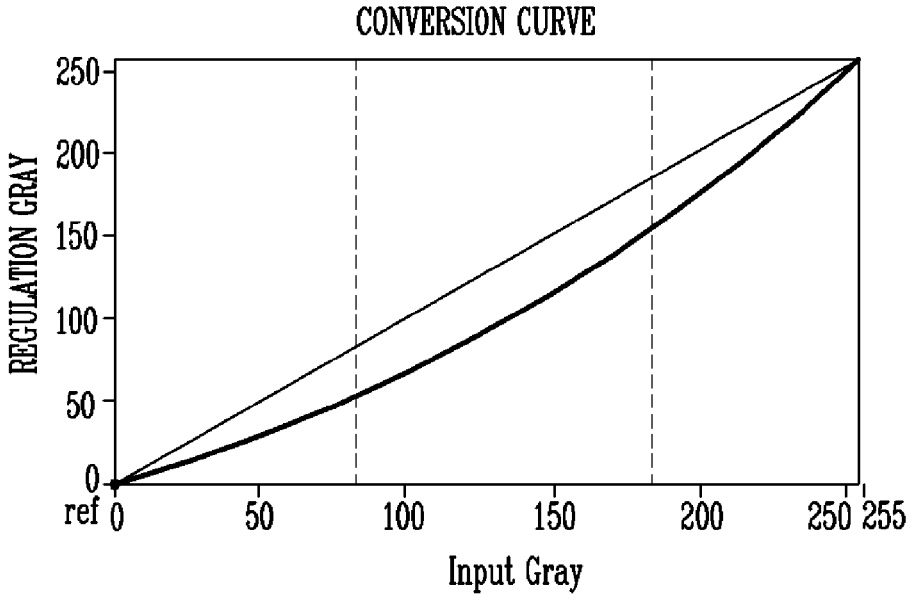
FIG. 14 is a graph showing a relation between an input gray level of first data shown in FIG. 13 and a regulation gray level that is to be converted as a function of the input gray level.
Figure 15:
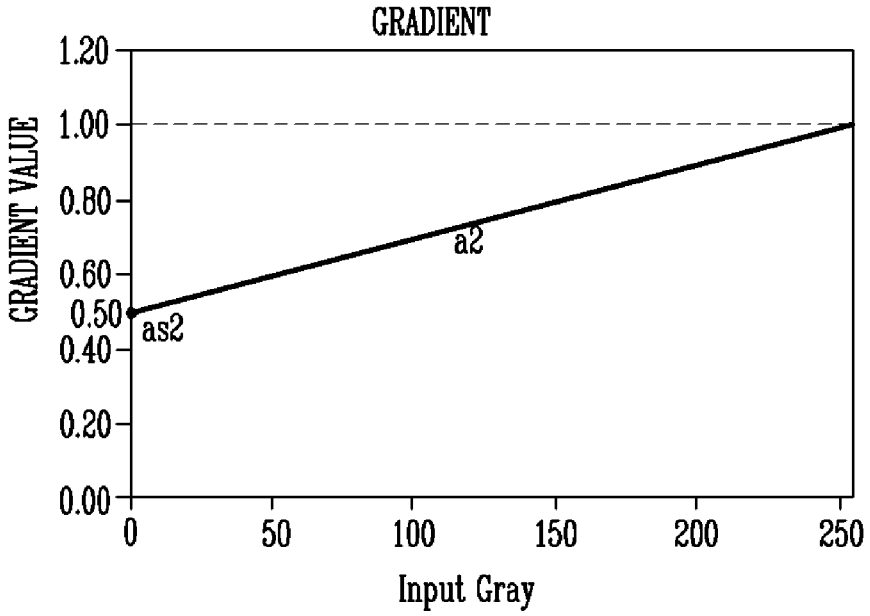
FIG. 15 is a graph showing a gradient applied to a conversion equation corresponding to the graph of FIG. 14.

FIG. 13 is a graph showing a relation between luminance distribution ranges and the number of pixels in an exemplary embodiment of the invention, FIG. 14 is a graph showing a relation between an input gray level of first data in FIG. 13 and a regulation gray level that is to be converted according to the input gray level, and FIG. 15 is a graph showing a gradient applied to a conversion equation corresponding to the graph of FIG. 14.

In an exemplary embodiment, the number of pieces of associated data (number of pixels of associated luminance of an image to be displayed) may be gradually increased from the first luminance distribution range to the third luminance distribution range.

FIG. 13 shows information that is output by the histogram analyzer 74, and represents a variation where the data (the number of the pixels) of the gray level distribution ranges is increased from the low luminance range (first luminance distribution range) to the high luminance range (third luminance distribution range), that is, a variation where the gray level distribution of data is increased from the low luminance range (first luminance distribution range) to the medium luminance range (second luminance distribution range), and the gray level distribution of data is increased from the medium luminance range (second luminance distribution range) to the high luminance range (third luminance distribution range).

FIG. 13 shows an exemplary embodiment of the histogram information where the data of the low gray level is less than the data of the medium gray level, and the data of the medium gray level is less than the data of the high gray level, that is, the number of the pixels emitting light with the low luminance is less than the number of the pixels emitting light with the medium luminance and the high luminance.

According to an exemplary embodiment of the invention, the gray level (input gray level) of the input data, namely, the first data is converted based on the variation between the data of the respective luminance distribution ranges. The gradient of the conversion equation for converting the gray level is continuously changed according to the input gray level.

FIG. 14 illustrates an operation of converting the gray level of data by the conversion curve generator 76.

That is, FIG. 14 is a graph representing a relation between the input gray level corresponding to the embodiment of FIG. 13 and the regulation gray level changed according to the input gray level, in which the X axis denotes the input gray level and the Y axis denotes the regulation gray level corresponding to the input gray level.

Referring to FIG. 14, the conversion equation (first conversion equation) for data having the gray level less than a reference gray-level value (ref) is different from the conversion equation (second conversion equation) for data having the gray level greater than the reference gray-level value (ref). The first and second conversion equations are as follows.

$$y=a1x; \text{ and}$$

$$a1=((1-as1)/\text{ref})\times x+as1. \qquad \text{First Conversion Equation:}$$

In the first conversion equation, as1 and ref are preset constants, as1 denotes a first gradient reference value, and ref denotes a reference gray-level value.

$$y=a2(x-\text{ref})+\text{ref}; \text{ and}$$

$$a2=((1-as2)/(255-\text{ref}))\times(x-255)+1. \qquad \text{Second Conversion Equation:}$$

In the second conversion equation, as2 is a preset constant and denotes a second gradient reference value.

In the first and second conversion equations, y denotes a regulation gray level, and x denotes an input gray level.

In such an embodiment, the reference gray-level value (ref) may be set to a minimum gray level, e.g., the gray level of zero (0) as shown in FIG. 14. In such an embodiment, since there is no data having a gray level less than the reference gray level, the first conversion equation is not used.

In an exemplary embodiment, when the variation in data of the gray level distribution ranges is increased from the low luminance range (first luminance distribution range) to the high luminance range (third luminance distribution range), the gray level of the data is converted only by the second conversion equation.

Thus, in FIG. 15, only the gradient a2 of the second conversion equation is shown.

FIG. 15 is a graph showing the gradient a2 that is applied to the second conversion equation. Referring to FIG. 15, in such an embodiment, the second gradient reference value as2 as the starting point of the gradient a2 of the second conversion equation may be 0.50.

In such an embodiment, as shown in FIG. 15, the gradient a1 of the first conversion equation may be set to 1 or less.

Referring to FIG. 14, according to an exemplary embodiment of the invention, a change in gradient is determined by analyzing variation in the gray level distribution of the data, namely, variation between the data of the respective luminance distribution ranges through the histogram analysis, and then applying the variation between the data of the respective luminance distribution ranges.

In such an embodiment, when the data of the gray level distribution ranges is gradually increased from the low luminance range (first luminance distribution range) to the high luminance range (third luminance distribution range), the gradient of the second conversion equation also increases in proportion to the increase in gray level distribution.

In such an embodiment of the invention, as described above, the gradient applied to the second conversion equation implemented in a linear equation is continuously changed according to the input gray level x, thus removing kink points that may occur in gamma correction and thereby improving the visibility of an image.

In an exemplary embodiment, referring to the graph of FIG. 14, a change in gradient in the third luminance distribution range is greater than changes in gradients in the first and second luminance distribution ranges.

Accordingly, a difference between the input and regulation gray levels is relatively greater in the third luminance distribution range in which a greater number of pixels are present, and a difference between the input and regulation gray levels is relatively less in the first and second luminance distribution ranges in which a less number of pixels are present.

Therefore, in such an embodiment, pieces of data belonging to the third luminance distribution range having the relatively greater number of pixels are effectively distinguished from each other when displayed as an image.

Figure 16:
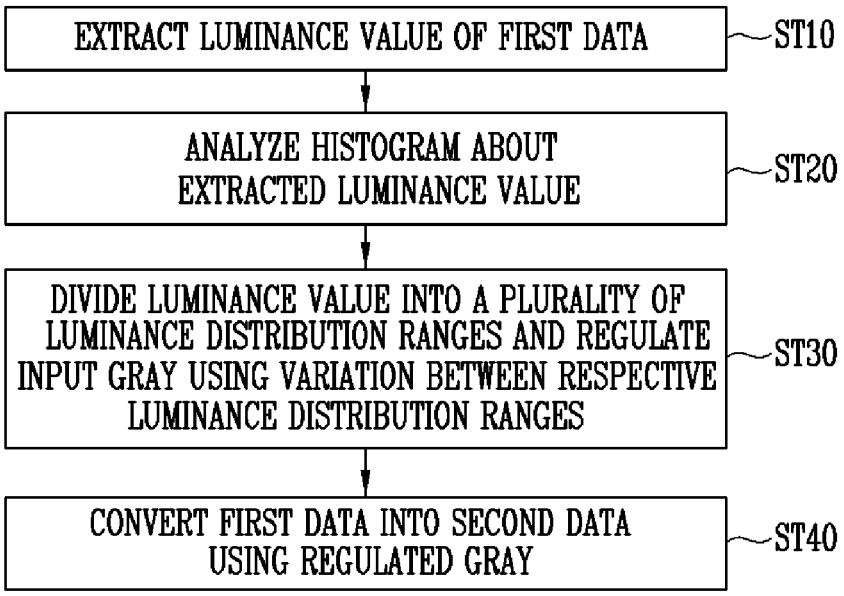
FIG. 16 is a flowchart showing an exemplary embodiment of a method of driving a display device according to the invention.

FIG. 16 is a flowchart showing an exemplary embodiment of a method of driving a display device according to the invention.

Referring to FIG. 16, in an exemplary embodiment, Y values (luminance values) that are luminance components of the external data signal, e.g., the first data Data, are extracted (ST 10).

In one exemplary embodiment, for example, RGB data that is the first data Data may be input and then converted into data including luminance values and chrominance values. That is, one piece of first data may be converted into one luminance value Y and two chrominance values, and the chrominance value may include a blue chrominance value Cb and a red chrominance value Cr.

In such an embodiment, histogram information about the luminance value of the first data is analyzed, and the number of the pixels emitting light with respective extracted luminance is calculated (ST 20).

In such an embodiment, the pieces of the first data are divided into the plurality of luminance distribution ranges using the luminance distribution information about the first data determined through the histogram analysis, and the gray level (input gray level) of the first data is regulated to improve the visibility using the corresponding conversion equation depending on the variation between the data of the respective luminance distribution ranges (ST 30).

In such an embodiment, the conversion equation for regulating the input gray level by the analysis of the histogram information and the variation between the data of the respective luminance distribution ranges is substantially the same as the conversion equations described above with reference to FIGS. 4 to 15, and any repetitive detailed description thereof will be omitted.

In such an embodiment, the first data Data is converted into the second data Data' using the regulated gray level, and the converted second data is output to the data drive unit 20 (ST 40).

In such an embodiment, the second data Data' may be RGB data. In such an embodiment, the first data is converted from RGB data to YCbCr, and then converted back to the RGB data.

As described above, in exemplary embodiment of the invention, the visibility of an image is improved by extracting a luminance component from input image data, determining the luminance distribution of the image data through a histogram analysis, dividing the luminance distribution into a plurality of luminance distribution ranges, and converting the image data using a corresponding conversion equation based on a variation between the data of respective luminance distribution ranges.

In such an embodiment, the visibility of an image is improved by continuously changing a gradient applied to a conversion equation according to the gray level of input image data and thereby removing a kink point that may occur in gamma correction.

Exemplary embodiments of the invention have been disclosed herein, and although specific terms are employed, they are used and are to be interpreted in a generic and descriptive sense only and not for purpose of limitation. In some instances, as would be apparent to one of ordinary skill in art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in art that various changes in form and details may be made without departing from the spirit and scope of the invention as set forth in the following claims.

What is claimed is:

1. A display device comprising:

a pixel unit comprising:

a plurality of scan lines;

a plurality of data lines crossing the scan lines; and a plurality of pixels connected to the scan lines and the data lines;

a timing controller that receives first data from an outside, wherein the pixel unit displays an image corresponding to the first data;

a converter that receives the first data from the timing controller, to extract luminance components of the first data corresponding to the pixels to determine luminance distribution of the first data, divides the luminance distribution into a plurality of luminance distribution ranges, and converts the first data into second data by regulating an input gray level of the first data based on a conversion equation corresponding to a variation between data of the luminance distribution ranges; and a data driver that receives the second data from the converter and to provide the second data to the data lines, wherein a gradient of the conversion equation for regulating the input gray level is continuously changed depending on the input gray level of the first data.

2. The display device as claimed in claim 1, wherein the converter comprises:

a first data converter that extracts the luminance components of the first data corresponding to the pixels;

a histogram analyzer that performs a histogram analysis on the extracted luminance components of the first data to determine the luminance distribution of the first data by analyzing histogram information about the extracted luminance components, and calculating a number of respective pixels corresponding to the extracted luminance components;

a conversion curve generator that divides the luminance distribution into the plurality of luminance distribution ranges based on the luminance distribution of the first data, and regulates the input gray level of the first data using the conversion equation corresponding to the variation between the data of the luminance distribution ranges;

and a second data converter that converts the first data into the second data using the regulated gray level.

3. The display device as claimed in claim 1, wherein the plurality of luminance distribution ranges comprise:

a first luminance distribution range which is a low luminance range;

a second luminance distribution range which is a medium luminance range; and a third luminance distribution range which is a high luminance range.

4. The display device as claimed in claim 3, wherein when the data of the first and second luminance distribution ranges among the plurality of luminance distribution ranges is increased from the first luminance distribution range to the second luminance distribution range, the gradient of the conversion equation increases as the input gray level of the first data increases in the first luminance distribution range and the second luminance distribution range, and when the data of the first and second luminance distribution ranges decreases from the first luminance distribution range to the second luminance distribution range, the gradient of the conversion equation decreases as the input gray level of the first data increases in the first luminance distribution range and the second luminance distribution range.

5. The display device as claimed in claim 4, wherein the conversion equation is one of a first conversion equation for regulating the input gray level of the first data less than a preset reference gray-level value (ref) and a second conversion equation for regulating the input gray level of the first data greater than the reference gray-level value (ref).

6. The display device as claimed in claim 5, wherein the first conversion equation satisfies the following equation:

$$\text{regulation gray level}(y)=\text{first gradient}(a1)\times\text{input gray level}(x),$$

the first gradient (a1) satisfies the following equation:

$$a1=((1-\text{first gradient reference value}(as1))/\text{reference gray-level value}(\text{ref}))\times\text{input gray level}(x)+\text{first gradient reference value}(as1),$$

the second conversion equation satisfies the following equation:

$$\text{regulation gray level}(y)=\text{second gradient}(a2)\times(\text{input gray level}(x)-\text{reference gray-level value}(\text{ref}))+\text{reference gray-level value}(\text{ref}),\ \text{and}$$

the second gradient (a2) satisfies the following equation:

$$a2=((1-\text{second gradient reference value}(as2))/(\text{maximum gray level}-\text{reference gray-level value}(\text{ref}))\times(\text{input gray level}(x)-\text{maximum gray level})+1,$$

where the first gradient reference value (as1) and the second gradient reference value (as2) are preset constants corresponding to the variation between the data of the luminance distribution ranges.

7. The display device as claimed in claim 6, wherein when the data of the first luminance distribution range and the second luminance distribution range decreases from the first luminance distribution range to the second luminance distribution range and the data of the second luminance distribution range and the third luminance distribution range increases from the second luminance distribution range to the third luminance distribution range, the reference gray-level value (ref) is set to be a gray-level value within the second luminance distribution range.

8. The display device as claimed in claim 7, wherein
the reference gray-level value is set to be a gray level of 150,
the first gradient reference value (as1) is set to be 2,
the second gradient reference value (as2) is set to be 0.25,
the gradient (a1) of the first conversion equation is set to be 1 or greater, and
the gradient (a2) of the second conversion equation is set to be 1 or less.

9. The display device as claimed in claim 6, wherein when the data of the first luminance distribution range and the second luminance distribution range increases from the first luminance distribution range to the second luminance distribution range and the data of the second luminance distribution range and the third luminance distribution range decreases from the second luminance distribution range to the third luminance distribution range, the reference gray-level value (ref) is set to be a gray-level value within the second luminance distribution range.

10. The display device as claimed in claim 9, wherein
the reference gray-level value is set to be a gray level of 125,
the first gradient reference value (as1) is set to be 0.25,
the second gradient reference value (as2) is set to be 2,
the gradient (a1) of the first conversion equation is set to be 1 or less, and
the gradient (a2) of the second conversion equation is set to be 1 or greater.

11. The display device as claimed in claim 6, wherein when the data of the first luminance distribution range and the second luminance distribution range decreases from the first luminance distribution range to the second luminance distribution range and the data of the second luminance distribution range and the third luminance distribution range decreases from the second luminance distribution range to the third luminance distribution range, the reference gray-level value (ref) is set to be a maximum gray level.

12. The display device as claimed in claim 11, wherein when the reference gray-level value is set to be the maximum gray level, the input gray level is converted using only the first conversion equation,
the first gradient reference value (as1) is set to be 1.80, and
the gradient (a1) of the first conversion equation is set to be 1 or greater.

13. The display device as claimed in claim 6, wherein when the data of the first luminance distribution range and the second luminance distribution range increases from the first luminance distribution range to the second luminance distribution range and the data of the second luminance distribution range and the third luminance distribution range increases from the second luminance distribution range to the third luminance distribution range, the reference gray-level value (ref) is set to be a minimum gray level.

14. The display device as claimed in claim 13, wherein when the reference gray-level value is set to the minimum gray level, the input gray level is converted using only the second conversion equation,
the second gradient reference value (as2) is set to be 0.50, and
the gradient (a2) of the second conversion equation is set to be 1 or less.

15. A method of driving a display device comprising:
extracting, by a converter, luminance components of first data provided from an outside, wherein a plurality of pixels of the display device display an image corresponding to the first data;
calculating, by the converter, the number of respective pixels corresponding to the extracted luminance components by analyzing histogram information about the extracted luminance components to determine luminance distribution of the first data;
dividing, by the converter, the luminance distribution into first to third luminance distribution ranges using information about luminance distribution of the first data determined based on the analyzed histogram information, and
regulating, by the converter, an input gray level of the first data using a conversion equation corresponding to a variation between the luminance distribution ranges; and
converting, by the converter, the first data into second data using the regulated gray level,
wherein a gradient of the conversion equation for regulating the input gray level is continuously changed depending on the input gray level of the first data.

16. The method as claimed in claim 15, wherein when data of the luminance distribution ranges is increased from a first luminance distribution range to a second luminance distribution range or from the second luminance distribution range to a third luminance distribution range, the gradient of the conversion equation increases as the input gray level of the first data increases in the first luminance distribution range and the second luminance distribution range or in the second luminance distribution range and the third luminance distribution range, and
when the data of the luminance distribution range decreases from the first luminance distribution range to the second luminance distribution range or from the second luminance distribution range to the third luminance distribution range, the gradient of the conversion equation decreases as the input gray level of the first data increases in the first luminance distribution range and the second luminance distribution range or in the second luminance distribution range and the third luminance distribution range.

17. The method as claimed in claim 15, wherein the conversion equation is one of a first conversion equation for regulating the gray level of the first data that is less than a preset reference gray-level value (ref), and a second conversion equation for regulating the gray level of the first data greater than the reference gray-level value.

18. The method as claimed in claim 17, wherein
the first conversion equation satisfies the following equation:

regulation gray level($y$)=first gradient($a1$)×input gray level($x$), the first gradient (a1) satisfies the following equation:

$a1$=((1−first gradient reference value($as1$))/reference gray-level value(ref))×input gray level($x$)+first gradient reference value($as1$), the second conversion equation satisfies the following equation:

regulation gray level($y$)=second gradient($a2$)×(input gray level($x$)−reference gray-level value(ref))+reference gray-level value(ref), the second gradient (a2) satisfies the following equation:

$a2$=((1−second gradient reference value($as2$))/(maximum gray level−reference gray-level value (ref))×(input gray level($x$)−maximum gray level)+1, where the first gradient reference value (as1) and the second gradient reference value (as2) are preset constants corresponding to the variation between the data of the luminance distribution ranges.

* * * * *